US009783994B2

(12) United States Patent
Chase

(10) Patent No.: US 9,783,994 B2
(45) Date of Patent: Oct. 10, 2017

(54) SELF-ALIGNING AND SELF-SPACING TILE SYSTEM

(71) Applicant: Noel Edmonds Chase, Toronto (CA)

(72) Inventor: Noel Edmonds Chase, Toronto (CA)

( * ) Notice: Subject to any disclaimer, the term of this patent is extended or adjusted under 35 U.S.C. 154(b) by 0 days.

(21) Appl. No.: 14/948,351

(22) Filed: Nov. 22, 2015

(65) Prior Publication Data

US 2017/0145699 A1 May 25, 2017

(51) Int. Cl.

| | |
|---|---|
| ***E04F 15/02*** | (2006.01) |
| ***E04F 15/08*** | (2006.01) |
| ***E04F 15/10*** | (2006.01) |
| ***E04F 13/08*** | (2006.01) |
| ***E04F 13/18*** | (2006.01) |

(52) U.S. Cl.

CPC .... *E04F 15/02022* (2013.01); *E04F 13/0892* (2013.01); *E04F 13/18* (2013.01); *E04F 15/08* (2013.01); *E04F 15/10* (2013.01); *E04F 2201/0153* (2013.01)

(58) Field of Classification Search

CPC ..... E04F 15/02022; E04F 15/10; E04F 15/08; E04F 2201/0153; E04F 2201/0115; E04F 2201/0146; E04F 2201/0161

USPC ..... 52/177, 180, 181, 386, 387, 578, 580, 52/581, 588.1

See application file for complete search history.

(56) References Cited

U.S. PATENT DOCUMENTS

| | | | | |
|---|---|---|---|---|
| 5,118,547 | A * | 6/1992 | Chen | E01C 5/20 404/41 |
| 5,776,582 | A * | 7/1998 | Needham | B32B 3/06 428/116 |
| 9,038,341 | B2 * | 5/2015 | Lam | E04F 15/02038 52/381 |
| 2003/0061772 | A1 * | 4/2003 | Bertolini | E01C 5/22 52/177 |
| 2008/0199676 | A1 * | 8/2008 | Bathelier | E04F 13/08 428/223 |
| 2013/0291457 | A1 * | 11/2013 | Tillery | E04F 15/22 52/177 |
| 2015/0059274 | A1 * | 3/2015 | Shaffer | B32B 27/08 52/311.2 |

* cited by examiner

*Primary Examiner* — Brian Glessner
*Assistant Examiner* — Adam Barlow

(57) ABSTRACT

A tile system has been devised that includes novel, integral self-aligning and self-spacing features on the side walls of the tiles to provide uniform self-alignment continuously during installation in all directions, both on vertical and horizontal surfaces. Border and corner tiles with similar self-alignment features are shown. The self-alignment features will align the tiles in either a straight-laid or running bond (or brick) pattern. The self-alignment features define regular, parallel gaps between adjacent tiles, without the need for separate spacers, in which waterproof grout is applied. The self-alignment features have application with bonded and non-bonded tiles, driveway/walkway/deck pavers and mortared interior and exterior brick, which can be manufactured in a variety of materials and processes. This Invention pays particular attention to plastic injection molded tiles that are to be bonded to a surface and subsequently grouted.

8 Claims, 6 Drawing Sheets

(a) Front View, (b) Side View, (c) Rear View, (d) Detail A, and (e) Detail B of Square Tile

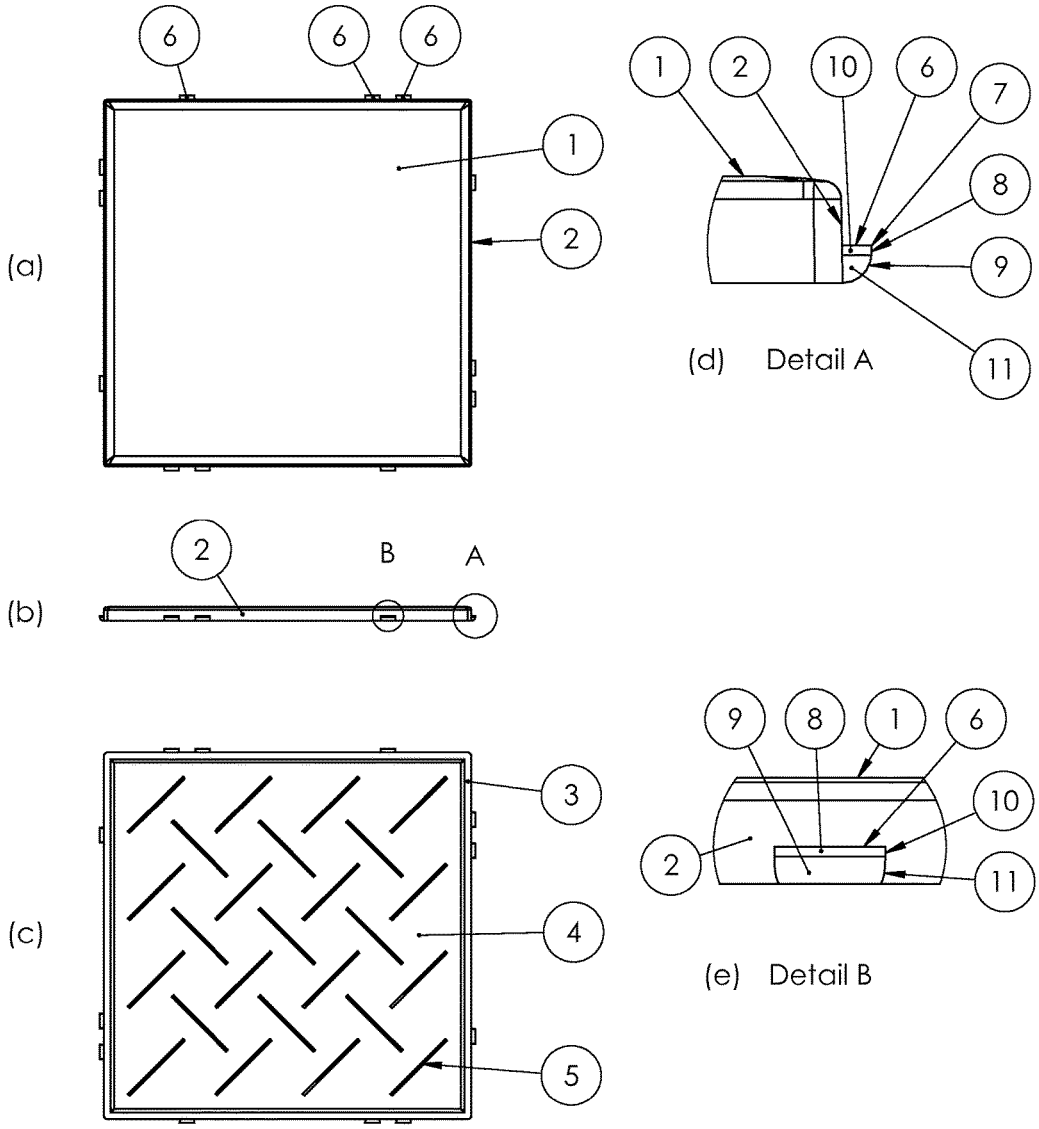
Fig. 1(a) Front View, (b) Side View, (c) Rear View, (d) Detail A, and (e) Detail B of Square Tile

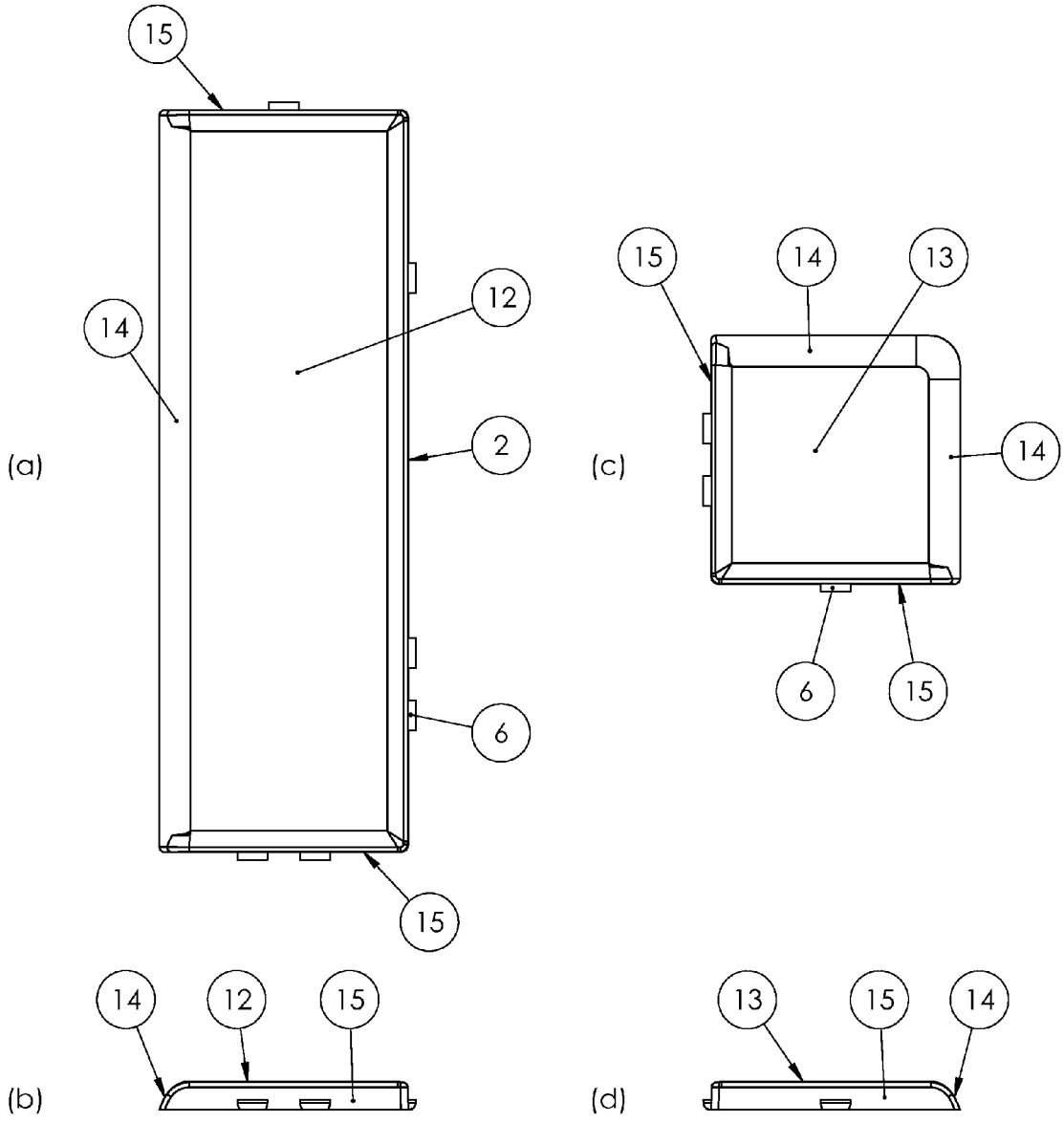
Fig. 2 (a) Front View and, (b) Side View of Border Tile, (c) Front View and,(d) Side View of Corner Tile

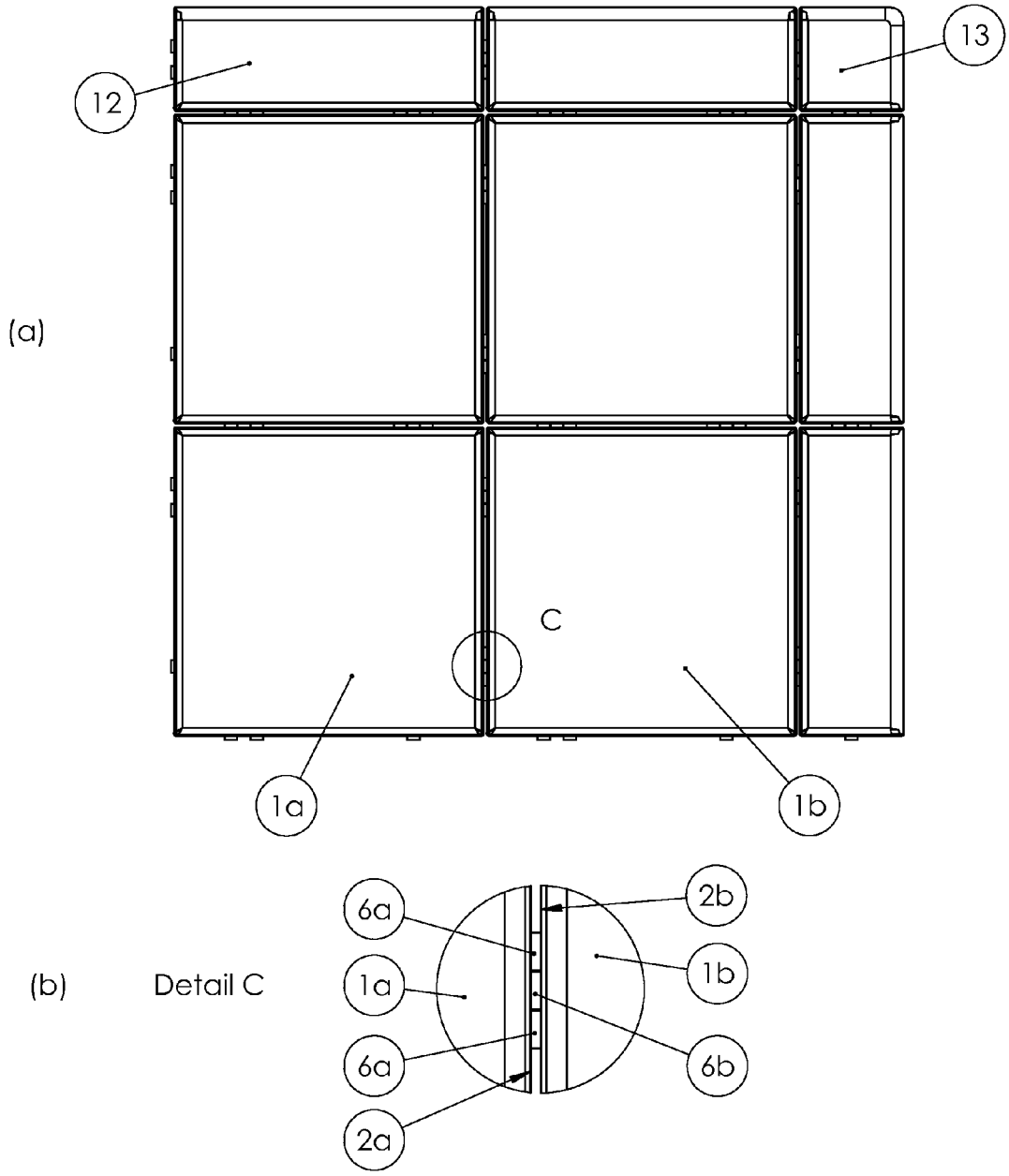
Fig. 3(a) Front View of Square Tiles, Border Tiles and Corner Tile in Straight-Laid Pattern, and (b), Detail C

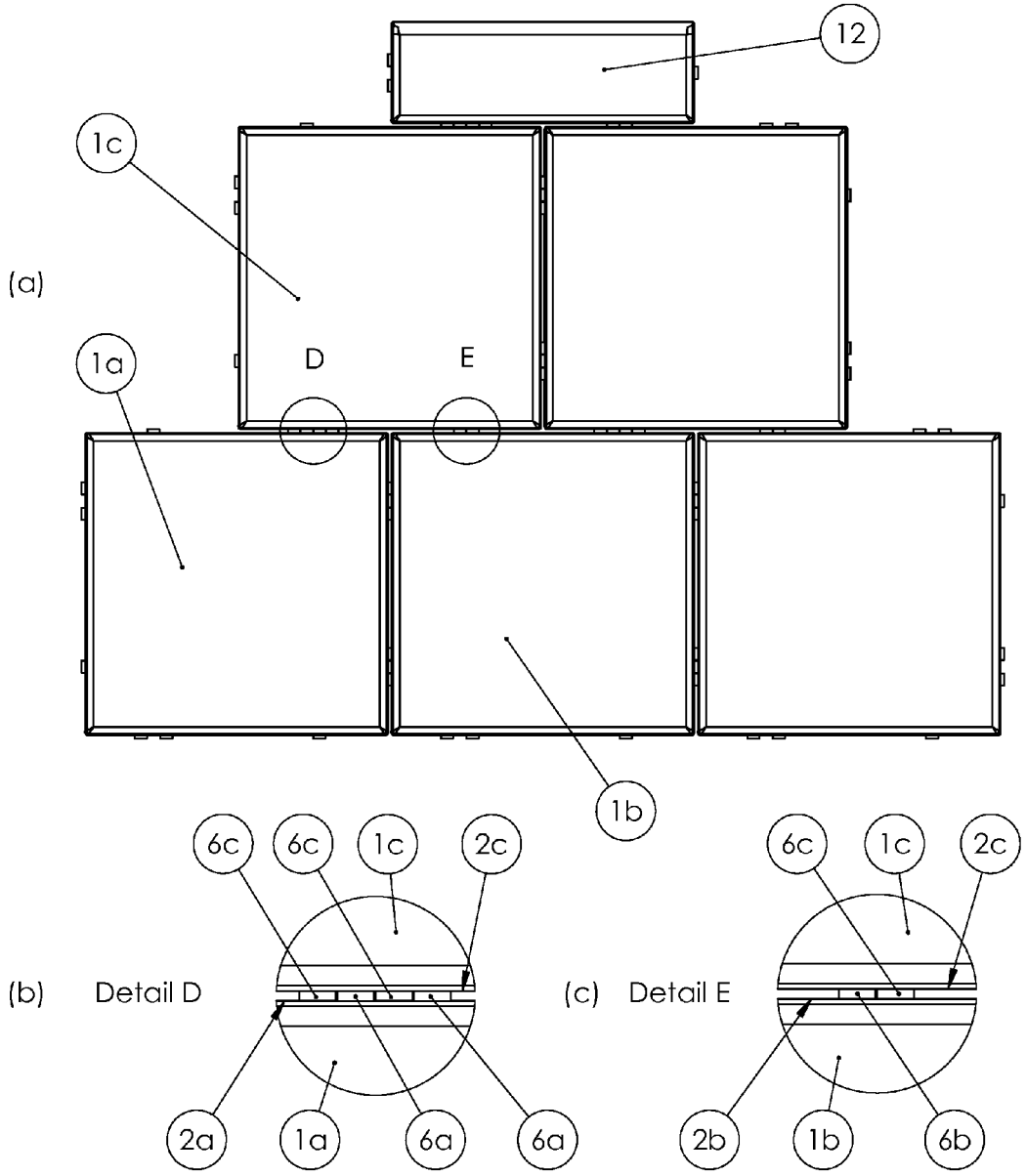
Fig. 4(a) Front View of Square Tiles and Border Tile in Running Bond Pattern, (b) Detail D, and (c) Detail E

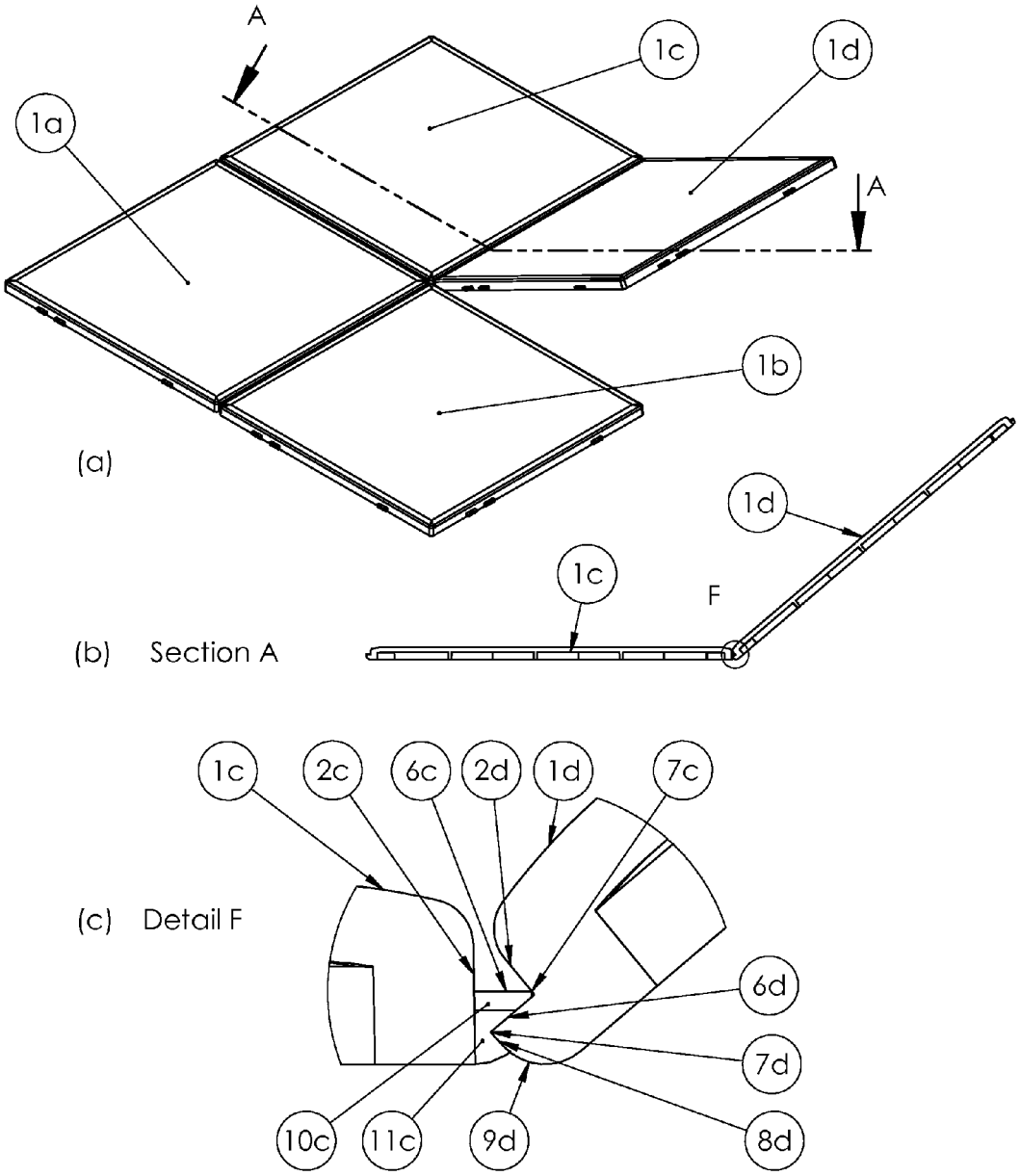
Fig. 5 (a) Isometric View of Square Tiles being laid in Straight-Laid Pattern with 4th Tile in initial position, (b) Section A, and (c) Detail F

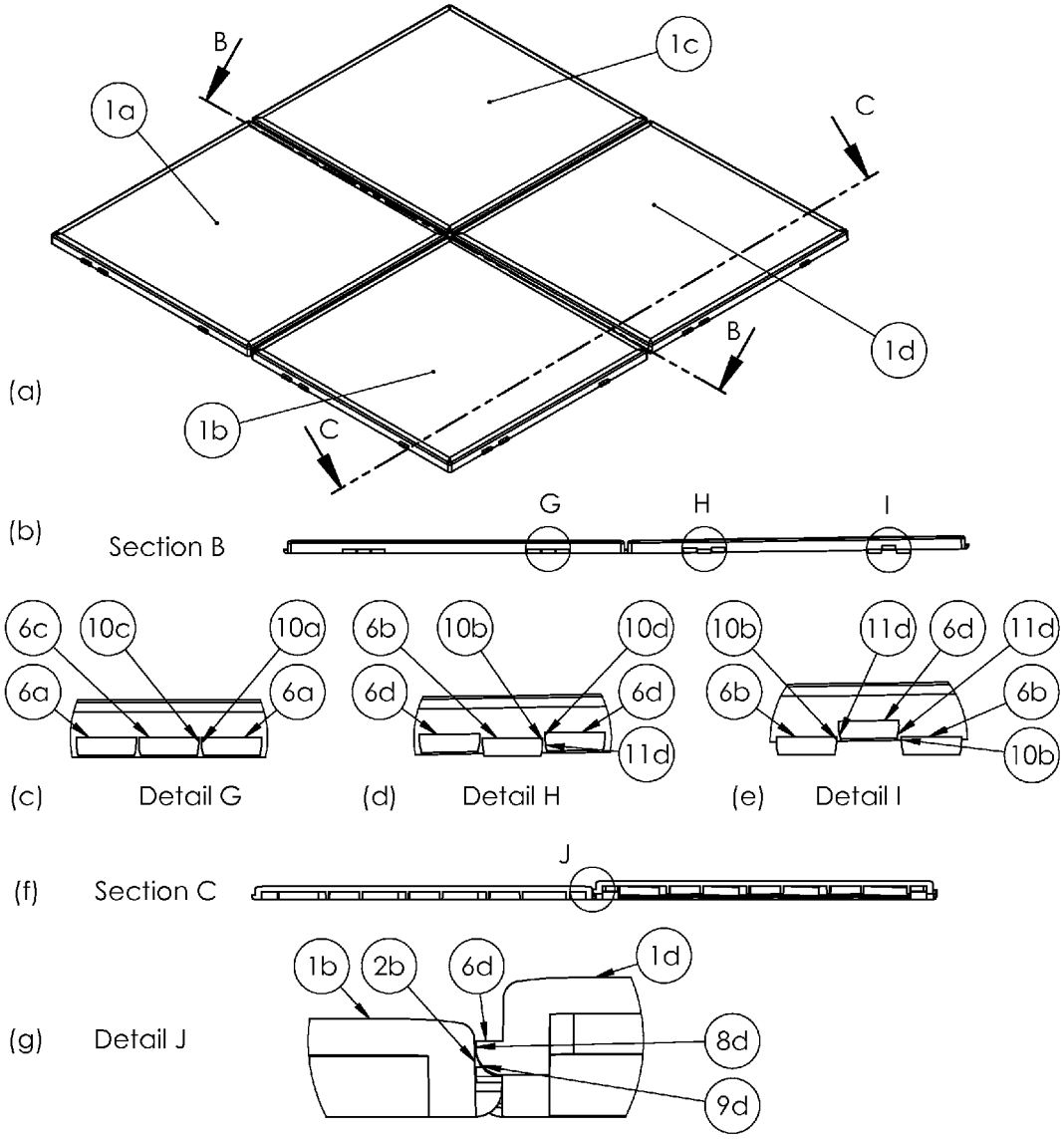
Fig. 6 (a) Isometric View of Square Tiles being laid in Straight-Laid Pattern with 4th Tile almost installed, (b) Section B, (c) Detail G, (d) Detail H, (e) Detail I, (f) Section C, and (g) Detail J

SELF-ALIGNING AND SELF-SPACING TILE SYSTEM

STATEMENT REGARDING FEDERALLY SPONSORED RESEARCH OF DEVELOPMENT

No Federal Government support was received in the development of this Invention.

CROSS-REFERENCE TO RELATED APPLICATIONS

No cross-reference is made to other applications.

SEQUENCE LISTING, TABLE, OR COMPUTER PROGRAM LISTING

No sequence listing, table, or computer program is attached or accompanies this Application.

FIELD OF THE INVENTION

This Invention relates to wall, floor and ceiling tiles, made of ceramic, plastic or other relevant materials that are adhered to a surface and are subsequently grouted. Features are provided that allow the tiles to self-align and self-space in relation to each other during installation, without the need for separate spacers. This Invention also has applications with cementitious and plastic composite driveway/walkway/deck pavers, and also with interior and exterior bricks, where the self-alignment features would be useful to position them during installation.

BACKGROUND OF THE INVENTION

Planar tiles are adhered to a wall, floor or ceiling using an adhesive. Separate spacers are generally placed between the tiles during installation, to provide alignment and spacing. The spaces between the tiles are subsequently sealed with a water-resistant grout to prevent water from penetrating beyond the tiles into the supporting wall and structure. Tiles are typically arranged in uniform patterns.

Ceramic has been the material of choice for millennia of tile fabrication owing to its low material cost, water resistance and acceptance of colorful, hard surface finishes. Disadvantages of ceramic tiles include the inefficiencies arising from their weight, brittleness and their thru-hardness. Heavy ceramic tiles are costly to transport. They require specialized equipment to cut, and in the process are prone to break and create hazardous, airborne silica dust. In contrast, the fabrication of plastic tiles by injection molding allows for tiles that are relatively light, are easily cut with conventional wood cutting tools, have high impact strength, and can be formulated to provide flame retardant and anti-microbial properties that are inherent to ceramic tiles. The recent development of clear, high-gloss, hard coatings for plastics and of digital printing on plastic surfaces now permits durable and colorful plastic tiles to be produced. All the known attributes of injection molded plastic parts, including shape, texture, raised and relieved features, molded-in color and clarity, are easily incorporated into a plastic tile. Where necessary, plastic tiles can be deformed to contour around a curved surface, something not possible with rigid ceramic tiles.

This Invention discloses a means that allows the tiles to self-align and self-space during their installation, and includes integral aligning and spacing features on the tiles that replace the need for separate spacers typically required when installing conventional ceramic tiles. This Invention can be incorporated into both ceramic and plastic tiles, although the plastic injection molding process ensures that these features are accurately produced. Similarly, this Invention can be incorporated into driveway/walkway/deck pavers to facilitate alignment in straight-laid or running bond patterns.

The prior art includes a considerable number of interlocking floor and wall tiling systems as well as interlocking, engineered wood strip-flooring. All of these inventions focused on a desire to have the tiles or strip-flooring connect with each other while they were being aligned with each other. Interlocking flooring and decking systems typically "float" on the sub-floor, which allows for thermal expansion and contraction of the materials throughout the seasons, while ensuring they remain tightly connected. The prior art plastic floor and wall tiling systems included "male" features on two sides to mate with "female" features on the remaining two sides. The female features were typically located on the underside of the tile to cover the projecting male features. The strip-flooring systems had a male (or tongue) feature that engaged with a female (or groove) feature on the opposite side. In all cases, these interlocking features ensured that the tiles were kept tightly fitted. However, a consistent problem existed with all of these prior art systems in that the interlocking features prevented the tiles from being continuously installed in all four directions from a fixed tile. A layout that calls for a particular pattern to be in the center of the floor or wall requires that the remaining tiles be aligned outward in all directions from this central feature. The tiles on the back wall of a bathtub surround are typically installed from a centerline outward to ensure both end-cuttings match. At best, the interlocking features provide for three directions, but more typically only two. The only exception is a dovetail interlock with symmetric features on all sides. However, owing to the narrow grout joint typically required between adhered wall and floor tiles, this concept cannot be rendered into a practical design. For these reasons, grouted wall and floor tiles have not included interlocking features and still require secondary spacers during installation to provide spacing and alignment. Furthermore, interlocking features force the tiles into a rigidly aligned pattern, which does not allow for variations that might be present in the wall or floor surface. Therefore, for wall and floor tiles that are adhered to a surface and subsequently grouted, it is undesirable to have the tiles connect or interlock.

Brown (U.S. Pat. No. 2,490,577 and U.S. Pat. No. 2,490,577) disclosed a system of tongue and groove (or pin and eye) connectors for plastic tiles. These plastic tiles were widely installed in the 1950s and 60s, but had inherent problems. It was assumed that having the tiles tightly fitted, without a grouted gap, was sufficiently waterproof to avoid water infiltration to the supporting wall. This proved otherwise, as mildew quickly built up behind and between the tiles. Unidirectional assembly for the tongue and groove design meant that traditional symmetries of tiling could not be achieved. This lead to tiling jobs that looked unbalanced. In addition, repair of damaged tiles was not possible without damaging adjacent tiles in the pin and eye method of attachment owing to a failure to foresee that a closed-loop captured flush to the wall cannot be removed from a pin mate. Masanek (U.S. Pat. App. No. 2013/0086861) is essentially the same patent as Brown's U.S. Pat. No. 2,490,577.

In the meantime, considerable development and commercialization of interlocking floor tiling and strip-flooring systems has occurred. In all cases, the desired result of the interlocking connection was to have the tiles secured tightly together. Shirakawa (U.S. Pat. No. 5,972,655) disclosed a two-stage connection of which the first stage includes features that appear to allow the deckings to be assembled in four directions, but would not be possible to complete the second stage. His invention disclosed a hook feature on the side of a first decking that inserted into a receptacle on the underside of a second decking, by first passing through an opening in its lower side wall. He disclosed that the inclined upper surface of the hook facilitated insertion of the hook into the receptacle by having it remain in contact with a series of mating curved ribs on the inside wall above the opening in the second decking so as to guide it into the receptacle. Once fully assembled, the mating ribs increased the contact area with the inclined upper surface, which facilitated a tight engagement, and thus a tight and reliable connection between the two deckings. His full disclosure, including the secondary fixture to secure the deckings together, is consistent with having the second decking lifted slightly to allow the tip of the hook on the first decking to pass through the opening and then having the second decking pressed down lightly to allow the ribs to guide the hook into the receptacle, similar to the way most other interlocking tiling systems are assembled. Assuming for the moment that each decking is secured down after installation (as is the case with tiles adhered to a surface), by having the hook features of one decking pass under the mating decking, it is only possible to continuously assemble the deckings in three directions. There will always be the case in one direction, where the hooks on the two sides of the next decking cannot simultaneously get through the openings of the two adjacent secured deckings. Sjoberg (US-2003/0094230) disclosed an interconnecting means for strip-flooring, which ensured that the flooring was tightly interlocked. He discloses a continuous projecting feature on one edge, which can be rotated into a mating groove on the adjacent flooring. As with Shirakawa's invention, the projecting interconnecting feature on one flooring is covered by adjacent flooring, which would then not be a suitable means for allowing tiling to be assembled in 4 directions.

SUMMARY OF THE INVENTION

This Invention overcomes the limitation of all the prior art, where the end result is to have aligned and equally spaced tiles that are bonded to a surface and subsequently grouted. Integral alignment and spacing features are provided, which eliminate the need for secondary spacers while enabling the tiles to be bonded to a surface in all four directions. Thus, the disclosed tiles can be laid symmetrically from a centerline as is typically required on the back wall of a bathtub surround. Further, these tiles can be aligned in either a straight-laid or running bond pattern. Border and corner tiles with similar alignment features are disclosed. Where reference is made to wall tiles being installed vertically in every direction, floor and ceiling tiles can be installed horizontally in every direction (left, right, forward, backward).

As mistakes in a pattern layout and damage to the tiles can occur during an installation, removal of individual tiles can be achieved without damaging adjacent tiles.

While reference is made throughout this Invention to tiles that are generally rectangular in shape, the self-aligning system can be incorporated into many different tile shapes.

This Invention also has use for cementitious and plastic composite driveway/walkway/deck pavers, whereby the self-aligning and self-spacing features will aid in positioning the pavers in a straight-laid or running bond pattern on the ground. Furthermore, the Invention has use with exterior bricks, whereby the self-aligning and self-spacing features will aid in positioning the bricks exactly in a running bond or brick pattern while the mortar is being squeezed out.

BRIEF DESCRIPTION OF THE DRAWINGS

In the drawings, which illustrate embodiments of the invention:

FIG. 1 is a front, side and rear view of a square tile, with detail views of the self-aligning and self-spacing feature FIG. 2 is a front and side view of a border and a corner tile FIG. 3 is a front view of a straight-laid installation of multiple square tiles, border tiles and a corner tile, with a detail view of the self-alignment features of two adjacent tiles.

FIG. 4 is a front view of a running bond installation of multiple square tiles and a border tile, with detail views of the alignment features of three adjacent tiles.

FIG. 5 is an isometric view of four squares tiles being laid in a straight-laid pattern, showing the $4^{th}$ tile being initially aligned with the $3^{rd}$ tile. A section view, along with a detail view, shows details of the contacting surfaces during the initial alignment.

FIG. 6 is an isometric view of four squares tiles being laid in a straight-laid pattern, showing the $4^{th}$ tile almost in its final position. A section view longitudinally through three sets of self-alignment features, further elaborated in three detail views, shows three stages of the self-alignment features laterally aligning with each other. A second section view, further elaborated by a detail view, shows how the projected profile of the self-alignment feature aids with the alignment and spacing of the tiles.

DETAILED DESCRIPTION OF THE INVENTION

A self-aligning and self-spacing square tile in the preferred embodiment of this Invention is shown in front view in FIG. 1(*a*). The tile can be produced using a variety of materials and processes. Furthermore, the tile can be rectangular or other multi-sided or rounded shapes. Cosmetic face 1, which can include shapes, textures, graphics and coatings, provides the aesthetic appearance of the tile. The four side walls 2 each support three integral self-alignment features, for which the top surface 6 for each is indicated. The quantity, relative position and shape of these self-alignment features are critical to their functionality and form the basis of this Invention. For the square tiles, two self-alignment features are grouped near one end of each side wall 2 and a single self-alignment feature is positioned near the other end, the relevance of which will be more evident in subsequent views.

In FIG. 1(*b*), the side view of the square tile shows the self-alignment features originating from the bottom edge of side wall 2. All grouted tiles should be of sufficient thickness to ensure that the grout between them has adequate depth to create a water-resistant seal. This raises an important consideration about whether it is detrimental to the grout to have the self-alignment features left between the tiles. Most tile installers will argue that the commonly used separate spacers should be removed prior to grouting. This is partly because the separate spacers can, in some cases, be almost the height of the tiles, leaving little depth for the grout. But, more importantly, they are generally molded in a plastic material that cannot be bonded using tile adhesives (and grouts), thus ensuring that they can be easily removed prior to grouting. By leaving them between the tiles, they can become dislodged over time and create weaknesses in the grout. Integral self-alignment features, on the other hand, cannot become dislodged from the tiles and are made of the same material as the tile to which the grout will adhere. Furthermore, the relative height of the self-alignment features to the height of the tile itself is such that a sufficient grout depth can be ensured.

In FIG. 1(*c*), the rear view of the square tile shows the underside 4 of the cosmetic face 1. Ceramic tiles are typically quite thick to ensure they have sufficient strength for their relatively brittle composition. Shallow ribs are typically included on the underside of a ceramic tile to limit the thickness of the tile adhesive when the tile is pressed into position. A solid tile of uniform thickness reduces the likelihood of the solvents in the tile adhesive being trapped under the tile, which can inhibit the curing of some adhesives. A plastic tile also needs to be relatively thick to provide sufficient depth for the grout. However, thick sections in plastic molded parts are undesirable, as they increase material and processing costs and potentially contribute to cosmetic defects and warp. Thus, for a plastic tile, it is desirable to have a wall thickness under the cosmetic face 1 that is considerably less than the height of side wall 2, thus creating a hollow underside of the tile. Adhesives that readily bond to plastic, which chemically react or require a solvent (or water) to flash off prior to bonding, are suited to bonding the hollow plastic tiles. The side wall underside 3 provides a bonding surface around the entire perimeter of the tile. Ribs 5, extending from underside 4 flush to the bottom of the tile, provide support for cosmetic face 1 and additional bonding surfaces. The particular "deck plate" pattern shown allows for optimum support of a cut edge of the tile should a partial tile be needed for an installation. Additionally, ribs 5 are discontinuous to reduce the likelihood of causing warp in the plastic tile, yet allow the installer to slightly bend the tile when installing it on curved surfaces, something not possible with rigid ceramic tiles.

In FIG. 1(*d*), the side view of the self-alignment feature depicted in Detail A shows that it is a projection off side wall 2, originating at the bottom of the tile. The top surface 6 is substantially below the cosmetic face 1 to allow for adequate grout coverage and it projects outward to top edge 7 which can be filleted. Front face 8 extends downward from top edge 7 to join inward front curvature 9, which originates at the bottom of the side wall 2. The two sides of the self-alignment feature consist of side face 10 and, below it, inward side curvature 11, both of which are illustrated in Detail B in FIG. 1(*e*). The relevance of these details is more evident in the subsequent assembly views. Having front curvature 9 and side curvature 11 extend fully up to top face 6, thereby eliminating front face 8 and side face 10, is included in the preferred embodiment of this Invention.

In FIG. 2(*a*), a self-aligning and self-spacing border tile, of typical rectangular profile, is shown in front view. Cosmetic face 12 is supported on one longitudinal edge by side wall 2, and on the two lateral edges by end walls 15. A cosmetic edge 14 transitions cosmetic face 12 into the bottom of the tile, as shown in FIG. 2(*b*). Three self-alignment features are provided on side wall 2, as indicated by their top face 6, and are similarly positioned to those on the four side walls 2 of the square tile depicted in FIG. 1. On one end wall 15, one self-alignment feature is provided. And on the other end wall 15, two self-alignment features are provided. In FIG. 2(*c*), a self-aligning and self-spacing corner tile is shown in front view. Cosmetic face 13 is supported on two sides by end walls 15, which are of similar length as the end walls 15 on the border tile. One or two self-alignment features are provided on end walls 15, as indicated by their top face 6. Cosmetic edge 14 transitions cosmetic face 13 on two sides to the bottom edge of the tile, as shown in FIG. 2(*d*). The underside of both the border tile and the corner tile are of similar design as that of the square tile in FIG. 1. The geometry of the self-alignment features in FIG. 2 is identical to the geometry depicted in Details A and B of FIG. 1. The relevance of the positioning of these self-alignment features will become more evident in the subsequent assembly views.

In FIG. 3, the front view of square tiles, border tiles and a corner tile installed in a straight-laid pattern is shown. The cosmetic faces of representative examples have been identified by their respective cosmetic faces, 1*a* and 1*b*, 12, and 13. The relevance of the positioning and width of the self-alignment features on the side walls and end walls of the tiles is now more evident. Two square tiles 1*a* and 1*b* are butted up against each other. In the detail view in FIG. 3(*b*), the single self-alignment feature, identified as its top face 6*b*, near one end of the side wall 2*b* on tile 1*b*, fits closely between the dual self-alignment features, identified twice as 6*a*, on the side wall 2*a* of tile 1*a*. For the second set of three self-alignment features between tiles 1*a* and 1*b* immediately above those in Detail C, the single self-alignment feature on tile 1*a* fits closely between the dual self-alignment features on tile 1*b*. Similarly, for the border tile 12 and the corner tile 13, the single self-alignment feature on one end wall fits closely between the dual self-alignment features of the end wall of the adjacent tile. Thus, all the tiles are perfectly aligned with each other. Having additional sets of self-alignment features on each side wall or having more than single or dual self-alignment features is part of the preferred embodiment of this Invention. With the tiles butted up against each other, the specific distance that the self-alignment features project off the side walls then limits the spacing between the tiles and controls the grout gap. This is the self-spacing aspect of this Invention. Because plastic injection molded tiles can be molded very accurately, it is possible to size the tiles, along with their self-alignment features, such that they will be uniformly positioned in a standard dimension. Thus, 6-inch tiles could be positioned exactly every 6 inches. This makes it very easy for an installer to determine exactly how many full tiles are needed and what the width of any partial tiles will be. If the installer wants a slightly larger grout gap than is provided by the projected distance of the self-alignment features, separate spacers could be used to control the grout gap while the self-alignment features still provide lateral alignment of the tiles, as long as they remain in contact with one another.

In FIG. 4, the front view of square tiles and a border tile installed in a running bond (or brick) pattern is shown. Once again, the positioning and shape of the self-alignment features on the side walls of each tile play a critical role. In a running bond pattern, two sides of the tiles are aligned in the same way as those of the straight-laid pattern shown in FIG. 4 on the vertical sides of the tiles. On the horizontal sides in FIG. 4, the tiles are offset by half their width to create a running bond pattern. To clarify how the self-alignment features work for the horizontal sides, three square tiles are identified by their cosmetic faces 1*a*, 1*b*, and 1*c* in FIG. 4(*a*). In the detail view in FIG. 4(*b*), four self-alignment features appear nested together between tiles 1*a* and 1*c*. The dual self-alignment features, indicated twice as 6*a*, and the dual self-alignment features indicated twice as 6*c*, are integral to tiles 1*a* and 1*c*, respectively. The dual self-alignment features 6*c* are positioned to the left of the dual self-alignment features 6*a*. In FIG. 4(*c*), single self-alignment features 6*b* and 6*c* are integral to tiles 1*b* and 1*c*, respectively. The two self-alignment features appear next to each other between tiles 1*b* and 1*c* in the running bond pattern, with the single self-alignment feature 6*c* to the right of the single self-alignment feature 6*b*. Although it is possible to offset the dual self-alignment features 6*c* to the right of dual alignment features 6*a*, an obvious gap would appear between the single self-alignment features 6*b* and 6*c*. The effect would be an "offset" running bond pattern, which may appeal to some installers. The self-alignment features on the longitudinal side of the border tile, identified by its cosmetic face 12, are positioned in the same way as they appear on the square tiles to achieve the running bond pattern.

In FIG. 5(*a*), four square tiles being laid in a straight-laid pattern are identified by their respective cosmetic faces 1*a* through 1*d*. With tile 1*a* installed first, tile 1*b* was then installed to its right and tile 1*c* above it. The installation process described for tile 1*d* is instructive as to how tiles 1*b* and 1*c* were installed with tile 1*a*. As would have been the case when tiles 1*b* and 1*c* were being installed with tile 1*a*, tile 1*d* is initially tilted on an angle and pushed up against the self-alignment features on tile 1*c*. Initially tilting tile 1*d*, as it is being positioned, avoids having its underside prematurely come in contact with the adhesive on the wall. In FIG. 5(*b*), the section view is through the self-alignment features of tiles 1*c* and 1*d*, which are shown in detail in FIG. 5(*c*) below it. Tile 1*d* slides on radius 9*d* as it is being pushed on an incline toward tile 1*c*. It comes to a stop as top edge 7*c* contacts side wall 2*d*. The projected distance of 6*c*, which controls the grout gap, also ensures that the tops of side walls 2*c* and 2*d* do not touch each other as tile 1*d* is inclined at a reasonable angle. While tile 1*d* is still being pushed against tile 1*c*, it is rotated downward into its final position in full contact with the installation surface with adhesive. (Final alignment of tile 1*d* with tile 1*b* is described separately in FIG. 6.) During this process, radius 9*d* slides in an angular motion against the installation surface, while side wall 2*d* pivots against top edge 7*c*. Top edge 7*d* rises up such that front face 8*d* comes in contact with side wall 2*c* when tile 1*d* is fully down. At this point, the front face 8*c* (not shown) would also be in contact with side wall 2*d*.

The views within FIG. 6 focus on the final alignment of tile 1*d* with tile 1*b* from FIG. 5, just before it contacts the installation surface. The right side of tile 1*d* is still slightly raised. In FIG. 6(*b*), the section view is taken between tiles 1*a* and 1*c* and tiles 1*b* and 1*d*, such that the self-alignment features on each of the tiles are sectioned. In the detail view in FIG. 6(*c*), the dual self-alignment features on tile 1*a* are identified twice by the top surfaces 6*a*, and the single self-alignment feature on tile 1*c* is identified as 6*c*. The side faces 10*a* and 10*c* are closely fitted with each other to provide lateral alignment of the two tiles in their final position. In the two detail views in FIG. 6(*d*) and FIG. 6(*e*), the dual and single self-alignment features on tiles 1*b* and 1*d* are identified by their respective top surfaces 6*b* and 6*d*. In FIG. 6(*d*), inward side curvature 11*d* is shown guiding side face 10*d* into position next to side face 10*b*. In FIG. 6(*e*), the two inward side curvatures 11*d* are shown just above the two side walls 10*b* to highlight how inward side curvatures 11*d* provide both guidance and clearance with side faces 10*b* to ensure a close lateral fit of the self-alignment features.

In FIG. 6(*f*), the section view is taken through tiles 1*b* and 1*d* at the self-alignment feature identified as 6*d* in FIG. 6(*e*), in order to show how tile 1*d* is angularly positioned with tiles 1*c* and 1*b*. The installer may not have fully pushed the top left corner of tile 1*d* against tile 1*c*, which would result in tile 1*d* being angularly rotated over top of tile 1*b*. In FIG. 6(*g*), the detail view shows how this is corrected. If front curvature 9*d* had initially been overtop side wall 2*b*, front curvature 9*d* would have contacted the corner between cosmetic face 1*b* and side wall 2*b*. As tile 1*d* is pushed down, front curvature 9*d* guides front face 8*d* up against side wall 2*b*, thereby rotating tile 1*d* into the correct position. While this is occurring, the self-alignment features on 1*d* that are adjacent to those on tile 1*c* are also being angularly positioned. Thus, when installed, tile 1*d* is both laterally and angularly locked into position with the adjacent tiles 1*b* and 1*c*. The true extent of this Invention is now defined.

The invention claimed is:

1. A self-aligning and self-spacing tile system that includes tiles of any shape and size, including border and corner tiles, and allows said tiles to be aligned in either a straight-laid or running bond tile pattern, said tiles comprising:

a cosmetic face and, for said border and corner tiles, one or more cosmetic edges;

side walls around the perimeter of said cosmetic face except where said cosmetic edges are present;

where said cosmetic edges are not present, at least one alignment and spacing means projecting from said side walls, said means is to be closely positioned with single or multiple similar means on the side walls of adjacent tiles to provide uniform alignment with and spacing between said sides walls;

said alignment and spacing means has a top surface below said cosmetic face which projects outward to a squared or filleted front edge from which a short front face extends below to meet an inward front curvature that originates at the bottom of said side wall, said top surface projects laterally in two directions to a side edge from which an inward side curvature extends below, intersecting said inward front curvature as it extends down to the bottom of said side wall.

2. The claims as in claim 1, further in which the height of said top surface is limited by the highest point of the side wall on an adjacent tile that has been inclined and butted up prior to final installation.

3. The claims as in claim 1, further in which said inward side curvature is a sweeping curvature that ensures, when a tile is positioned or rotated into place along any axis, that the clearance with respect to the top edge, side face, and inward side curvature of the alignment features on an adjacent installed tile is limited and controlled.

4. The claims as in claim 1, further in which said inward front curvature is adequately curved to allow a tile being installed to rotate against one installed tile and correct its spacing with another installed tile.

5. A self-aligning and self-spacing tile system that includes tiles of any shape and size, including border and corner tiles, and allows said tiles to be aligned in either a straight-laid or running bond tile pattern, said tiles comprising:

a cosmetic face and, for said border and corner tiles, one or more cosmetic edges;

side walls around the perimeter of said cosmetic face except where said cosmetic edges are present;

where said cosmetic edges are not present, at least one alignment and spacing means projecting from said side walls, said means is to be closely positioned with single or multiple similar means on the side walls of adjacent tiles to provide uniform alignment with and spacing between said sides walls;

said alignment and spacing means has a top surface below said cosmetic face which projects outward to a squared or filleted front edge that meets an inward front curvature that originates at the bottom of said side wall, said top surface projects laterally in two directions to a side edge from which an inward side curvature extends below, intersecting said inward front curvature as it extends down to the bottom of said side wall.

6. The claims as in claim 5, further in which the height of said top surface is limited by the highest point of the side wall on an adjacent tile that has been inclined and butted up prior to final installation.

7. The claims as in claim 5, further in which said inward side curvature is a sweeping curvature that ensures, when a tile is positioned or rotated into place along any axis, that the clearance with respect to the top edge, side face, and inward side curvature of the alignment features on an adjacent installed tile is limited and controlled.

8. The claims as in claim 5, further in which said inward front curvature is adequately curved to allow a tile being installed to rotate against one installed tile and correct its spacing with another installed tile.

* * * * *